US006167791B1

(12) United States Patent
Heckman et al.

(10) Patent No.: US 6,167,791 B1
(45) Date of Patent: Jan. 2, 2001

(54) CARRIAGE FOR FOOD SLICER

(75) Inventors: Thomas B. Heckman, Troy; Danny J. Mitchell, Franklin, both of OH (US); Robert Gerry Radwin, Waunakee, WI (US)

(73) Assignee: Premark FEG L.L.C., Wilmington, DE (US)

( * ) Notice: Under 35 U.S.C. 154(b), the term of this patent shall be extended for 0 days.

(21) Appl. No.: 08/880,494

(22) Filed: Jun. 23, 1997

Related U.S. Application Data

(60) Provisional application No. 60/023,987, filed on Aug. 15, 1996.

(51) Int. Cl.[7] ..... B26D 7/06

(52) U.S. Cl. ..... 83/719; 83/717; 83/729; 83/932

(58) Field of Search ..... 83/713, 717, 719, 83/720, 721, 722, 723, 729, 730, 435.11, 435.15, 435.16, 437.2, 932

(56) References Cited

U.S. PATENT DOCUMENTS

| | | | | |
|---|---|---|---|---|
| D. 259,883 | * | 7/1981 | Engebretsen | D7/381 |
| 806,603 | * | 12/1905 | Van Berkel | 83/713 |
| 1,685,906 | * | 10/1928 | Campbell | 83/717 |
| 1,889,538 | * | 11/1932 | Campbell | 83/729 |
| 1,972,254 | | 9/1934 | Wood | 83/730 |
| 1,993,849 | * | 3/1935 | Lucey | 83/717 |
| 2,004,603 | * | 6/1935 | Folk | 83/729 |
| 2,086,759 | | 7/1937 | Wood | 83/730 |
| 2,573,630 | * | 10/1951 | VanDuyn | 83/421 |
| 2,598,740 | | 6/1952 | Zimmermann | 83/717 |
| 2,663,341 | * | 12/1953 | Grove | 83/717 |
| 2,682,289 | * | 6/1954 | Brown | 83/717 |
| 2,691,397 | | 10/1954 | Klingens | 83/717 |
| 2,691,398 | * | 10/1954 | Klingens | 83/717 |
| 2,822,011 | | 2/1958 | Lundell | 83/729 |
| 2,962,069 | * | 11/1960 | Olsen et al. | 83/717 |
| 2,970,625 | | 2/1961 | Lundell | 83/729 |
| 3,051,207 | | 8/1962 | Hartley | 83/729 |
| 3,613,754 | * | 10/1971 | Hartley | 83/718 |
| 3,672,420 | * | 6/1972 | Hartley et al. | 83/401 |
| 3,704,736 | * | 12/1972 | Pratley | 832/397 |
| 3,857,310 | * | 12/1974 | Tiby | 83/26 |
| 3,958,478 | * | 5/1976 | Camper | 83/174 |
| 3,986,304 | * | 10/1976 | Shie, III | 83/174.1 X |
| 4,227,656 | * | 10/1980 | Engebretsen | 240/93 |
| 4,397,206 | | 8/1983 | Czala | 83/399 |
| 4,434,694 | * | 3/1984 | Scharsig | 83/410.7 |
| 4,813,316 | * | 3/1989 | Johnson et al. | 83/42 |
| 5,101,704 | * | 4/1992 | Jones et al. | 83/174 |
| 5,148,729 | * | 9/1992 | Krumdieck | 83/411.1 |
| 5,188,011 | * | 2/1993 | Somal et al. | 83/478 |
| 5,224,407 | * | 7/1993 | Koch et al. | 83/468.7 |
| 5,509,337 | * | 4/1996 | Norman et al. | 83/546 |
| 5,666,866 | | 9/1997 | Huang et al. | 83/77 |
| 5,687,626 | * | 11/1997 | Scherch et al. | 83/719 |

* cited by examiner

*Primary Examiner*—Clark F. Dexter
(74) *Attorney, Agent, or Firm*—Thompson Hine & Flory LLP

(57) ABSTRACT

A carriage for a food slicer; wherein the carriage includes a tray for supporting a food product. The tray has a relatively flat portion and an upstanding side portion, a food gripping portion attached to the tray and at least one handle attached to the side portion of the tray for moving the tray in a reciprocating motion past the slicing blade. Preferably, the carriage includes a second handle such that the user can grasp either handle. The tray also includes a slide rod for slidably supporting the food gripping portion. The slide rod may be optionally mounted to either side of the tray, before or after the food product.

6 Claims, 7 Drawing Sheets

CARRIAGE FOR FOOD SLICER

CROSS-REFERENCE TO RELATED APPLICATION

This application claims priority to U.S. Provisional Application No. 60/023,987 filed Aug. 15, 1996.

BACKGROUND OF THE INVENTION

The present invention relates to a carriage for a food slicer which holds the food product during slicing, and more particularly, to a carriage having two spaced handles and a carriage in which the means for supporting the food grip can be mounted in the front or back of the food product.

Slicing machines have been commercially available for many years. Typical food slicers have a rotatable, circular or disc-like slicing blade, and use a gravity feed to keep the food product in contact with the slicing blade. In such an arrangement, the rotating slicing blade is supported for rotation about an axis which is oriented in a plane extending at an angle to vertical, such as an angle of about 45 degrees. The slicers also generally include a gauge plate associated with the knife for determining the thickness of the slice and a carriage for supporting the food as it is moved past the cutting edge of the knife during slicing.

The food product-supporting carriage is mounted in a position generally perpendicular to the slicing plane and supports the food product as it reciprocates on a linear path past the cutting edge of the knife. To set the carriage in motion, the user must physically move the carriage by hand. As the carriage is withdrawn on its return stroke from the blade, the food product slides down the inclined carriage surface by the force of gravity and into contact with the gauge plate. As the carriage is then moved on its forward or slicing stroke, the food product will engage the knife and a slice will be removed, with the thickness of the slice being determined by the position of the gauge plate with respect to the knife.

Slicers of this type may be operated either manually or controlled automatically. When using an automatic control, a specific number of slices may be produced in a slicing operation, thereby adding convenience for the user and minimizing food product wastage. To enhance productivity, the slicer may also be able to control the stroke length for the carriage as well as the carriage speed.

However, conventional slicers have been inconvenient or difficult to use. The handles in the prior art slicers are often inconveniently located, uncomfortable to use, and may require the user to exert a high degree of force. Therefore, a need exists for an improved carriage for a food slicer which overcomes the disadvantages of the conventional slicers.

SUMMARY OF THE INVENTION

The present invention is a carriage for supporting a food product as it is carried past a slicing blade of a food slicer. In a preferred embodiment of the invention, the carriage includes two separate handles, an adjustable slide rod and is shaped to receive a slide rod on either of two opposed sides. The invention also optionally includes a handle support and a food grip having floating bushings.

In accordance with one aspect of the invention, the carriage for a food slicer includes a tray for supporting a food product, the tray having a relatively flat portion and an upstanding side portion, a food gripping portion attached to the tray, a first handle attached to the upstanding side portion of the tray for moving the tray in a reciprocating motion and a second handle attached to the upstanding side portion of the tray, wherein the second handle is at a location apart from the first handle.

In a preferred embodiment of this invention, at least one of the handles extends at an angle with respect to the tray and is adjustable. The handles are preferably sufficiently long so as to be grasped by a user in a plurality of locations on each said handle. When one of the handles is not in use, a cap is provided to cover a handle attachment on the carriage. In addition, the carriage may include a hanger for holding the gripping portion when not in use.

In accordance with a second aspect of the invention, the carriage for a food slicer includes a tray for supporting a food product, a food gripping portion attached to the tray, at least one handle attached to the tray for moving the tray, a slide rod removably attached to the tray such that the food gripping portion is slidably received on the slide rod, wherein the slide rod can be attached to either of the opposing sides of the tray.

In a preferred embodiment, the carriage includes two threaded rod attachments on the tray to receive a slide rod, the first attachment being located on one side of the tray and the second attachment being located on the opposing side of the tray. In this manner, the tray may receive the slide rod on either opposed side. The threaded attachments are preferably capped when not in use. The carriage also includes a support handle for connecting the food grip to the slide rod. The support handle is slidably received on the slide rod on a through hole. The carriage may also include a handle support to which the slide rod may be attached, wherein the handle support is attached to the tray and two handles are attached to the support such that they are attached on the upstanding retaining wall of the tray.

Accordingly, it is an object of the present invention to provide a carriage which has two handles to provide for more gripping combinations, and wherein the carriage is adjustable to provide additional flexibility in operation.

Other objects and advantages of the present invention will be apparent from the following description, the accompanying drawings and the appended claims.

DETAILED DESCRIPTION

Figure 1:
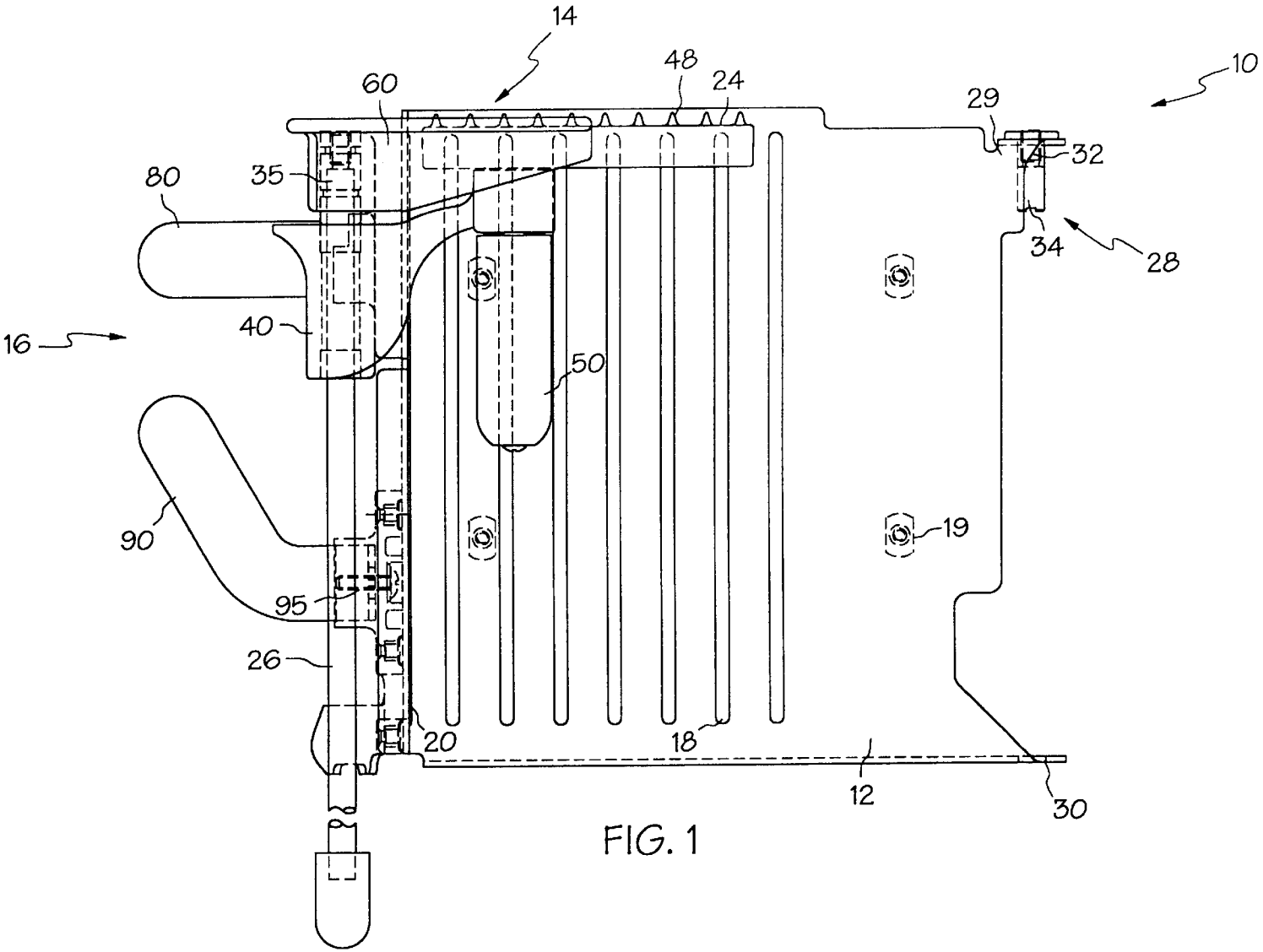
FIG. 1 is a top plan view of the carriage for a food slicer of the present invention.
Figure 2:
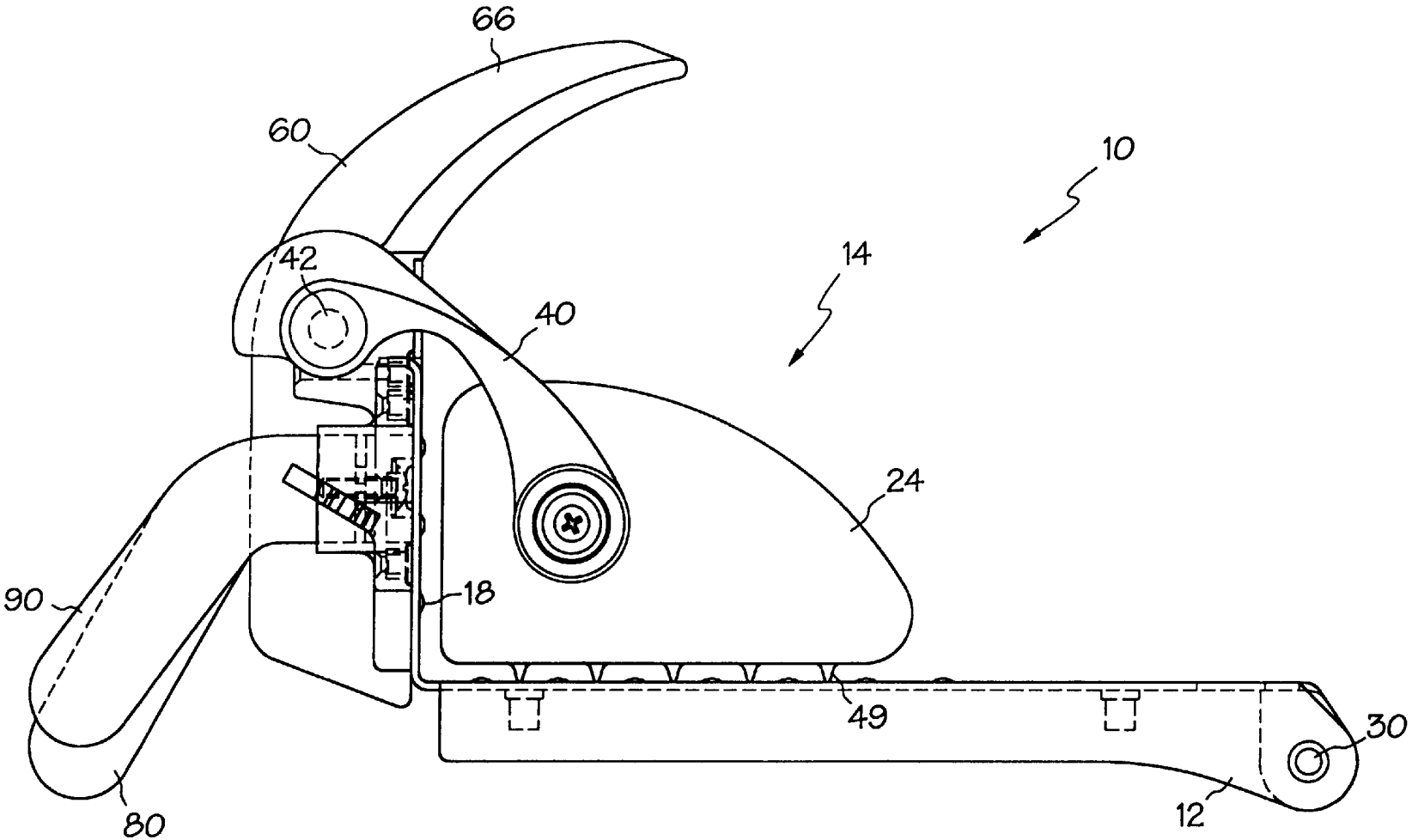
FIG. 2 is front elevational view of the carriage of FIG. 1.
Figure 3:
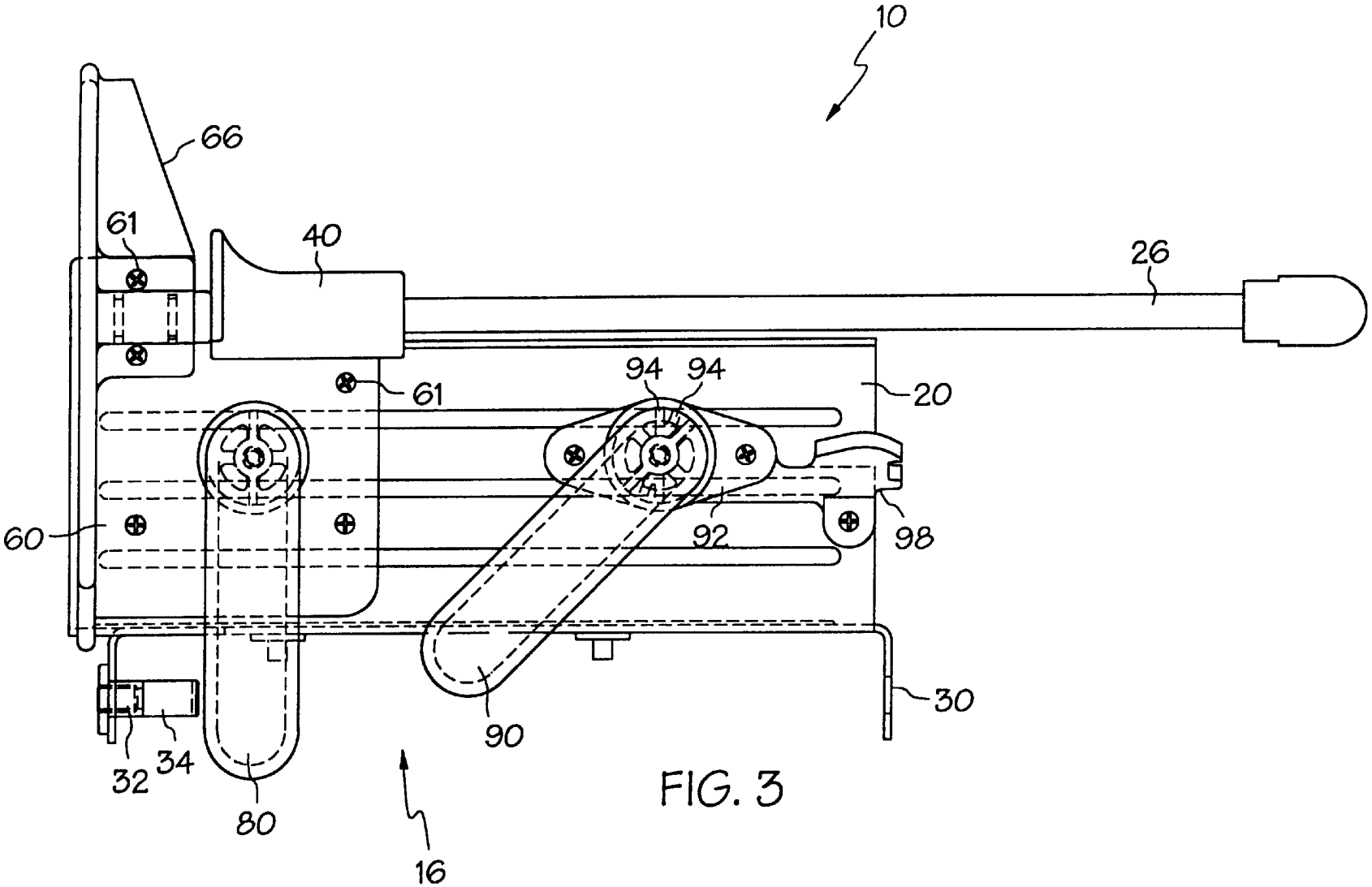
FIG. 3 is a left side elevational view of the carriage of FIG. 1.
Figure 7:
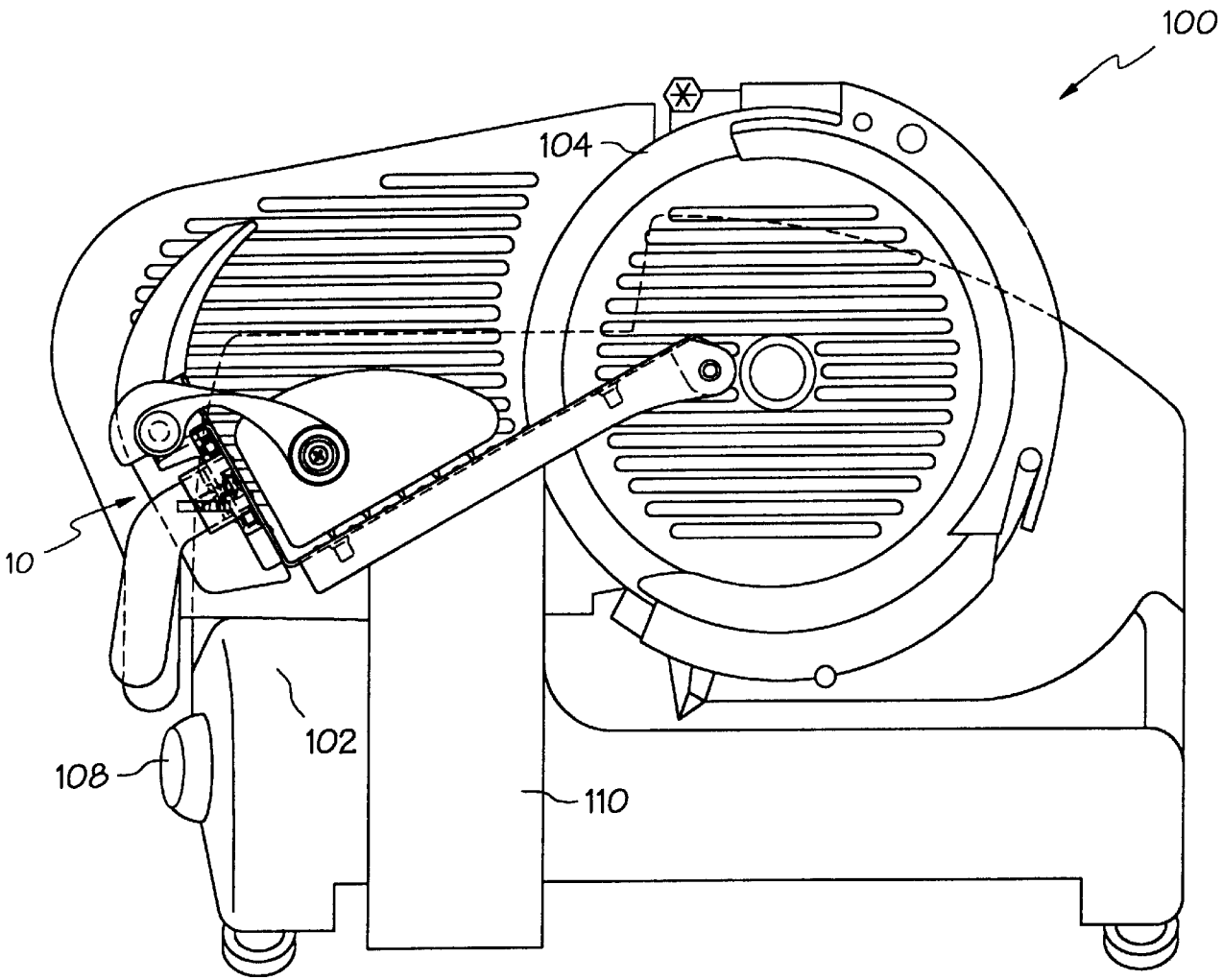
FIG. 7 is a view showing the slicer carriage of the present invention on a food slicer.

FIGS. 1–3 show a carriage for a food slicer generally designated 10 in accordance with the present invention. The carriage 10 is for use on a food slicer as shown in FIG. 7. The food slicer shown in FIG. 7, generally designated 100, is typically used for commercial slicing operations. It can be used for slicing meat, cheese, vegetables and other food products. The slicer includes a base 102 and motor driven circular slicing blade 104 having a peripheral cutting edge. The blade is mounted to the base 102 of the slicer and a motor rotates the slicing blade by means of a fixed-axis shaft. The carriage 10 is used to support the food product as it reciprocatingly traverses the blade. The carriage is reciprocatingly driven by hand or by a motor. To adjust the thickness of each food product slice, the machine preferably includes a gauge plate which is axially adjustable with respect to the plane of the blade. The slicer also preferably includes an adjustment knob 108 for adjusting the gauge plate.

The carriage 10 is supported on a carriage arm 110. The arm is in turn supported by a transport which reciprocates along a track under the base 102. The carriage 10 is either pivotally or removably attached to the slicer so that it may be removed or pivoted out of the way for cleaning or servicing. Once the carriage is moved away from the body of the slicer, the edge of the cutting blade is exposed. Therefore, an interlock is preferably provided which allows the user to move the carriage only if the gauge plate has been closed and the blade is covered.

The slicing blade is mounted so that it angles back slightly with respect to horizontal. The carriage is mounted perpendicular to the slicing blade. Therefore, the food product falls by means of gravity toward said blade when in the carriage. In this manner, when the food product in the carriage gets smaller, as it is being sliced, the product slides down the inclined carriage so that it is aligned to be sliced by the blade.

As shown in FIG. 1, the carriage includes a tray portion 12 for supporting the food product (not shown), a food gripping portion 14 and a handle portion 16. The tray portion 12 includes a generally rectangular flat plate having ribs 18 to support the food product in a slightly elevated manner from the tray and an upstanding retaining wall 20 which intersects and forms an L cross-section with the flat tray 12. The upstanding retaining wall 20 acts to contain the food product(not shown) to prevent it from sliding off of the tray. The upstanding portion 20 of the tray also includes ribs 18. The tray portion 12 further includes attachments 19 to attach the carriage 10 to the carriage arm 110. These attachments may be bolts which attach under the tray. The attachments should be recessed so that they do not extend onto the face of the plate. They should remain out of possible contact with the food product.

The food gripping portion 14 of the carriage includes a food grip 24 for holding the product so that the user may avoid contact with the food product, and a slide rod 26 for receiving the food grip. The slide rod has a threaded boss on one end and a rounded tip on the other. The threaded boss of the slide rod interconnects with a compatible threaded female portion 35 on the handle support 60.

The food grip 24 is slidably mounted on this slide rod 26 by an intermediate food grip support 40. This food grip support 40 is capable of easily sliding along slide rod 26, such that as the quantity of the food product in the carriage decreases as it is being cut, the food grip is capable of sliding down the slide rod toward the cutting blade to stay in contact with the food product.

The slide rod 26 is shown on the left side of the carriage 10 in FIG. 1. However, the carriage includes an alternative slide rod position 28 for optionally mounting the slide rod on the right side of the carriage 10. When the slide rod is mounted in the alternative position 28, it is preferable to use a shorter slide rod so that it does not interfere with use of the slicer. In this optional position, the carriage tray 12 includes a flange 29. Flange 29 includes a section which is perpendicular to the tray and supports a second threaded bore 32 which is the female equivalent of threaded boss of the slide rod 26. The slide rod can thereby be attached on the right side of the tray. To support the other end of the slide rod, a through hole 30 is provided through the top, right portion of the tray.

When this alternative slide rod position 28 is not being utilized, a cap 34 may be placed over the bore 32. Similarly, when the alternative slide rod position 28 is being used, the cap may be placed over bore 35. It will be apparent that when the secondary slide rod position 28 is used, a different food grip and food grip support will be required to direct the food grip forward on the tray.

Figure 5:
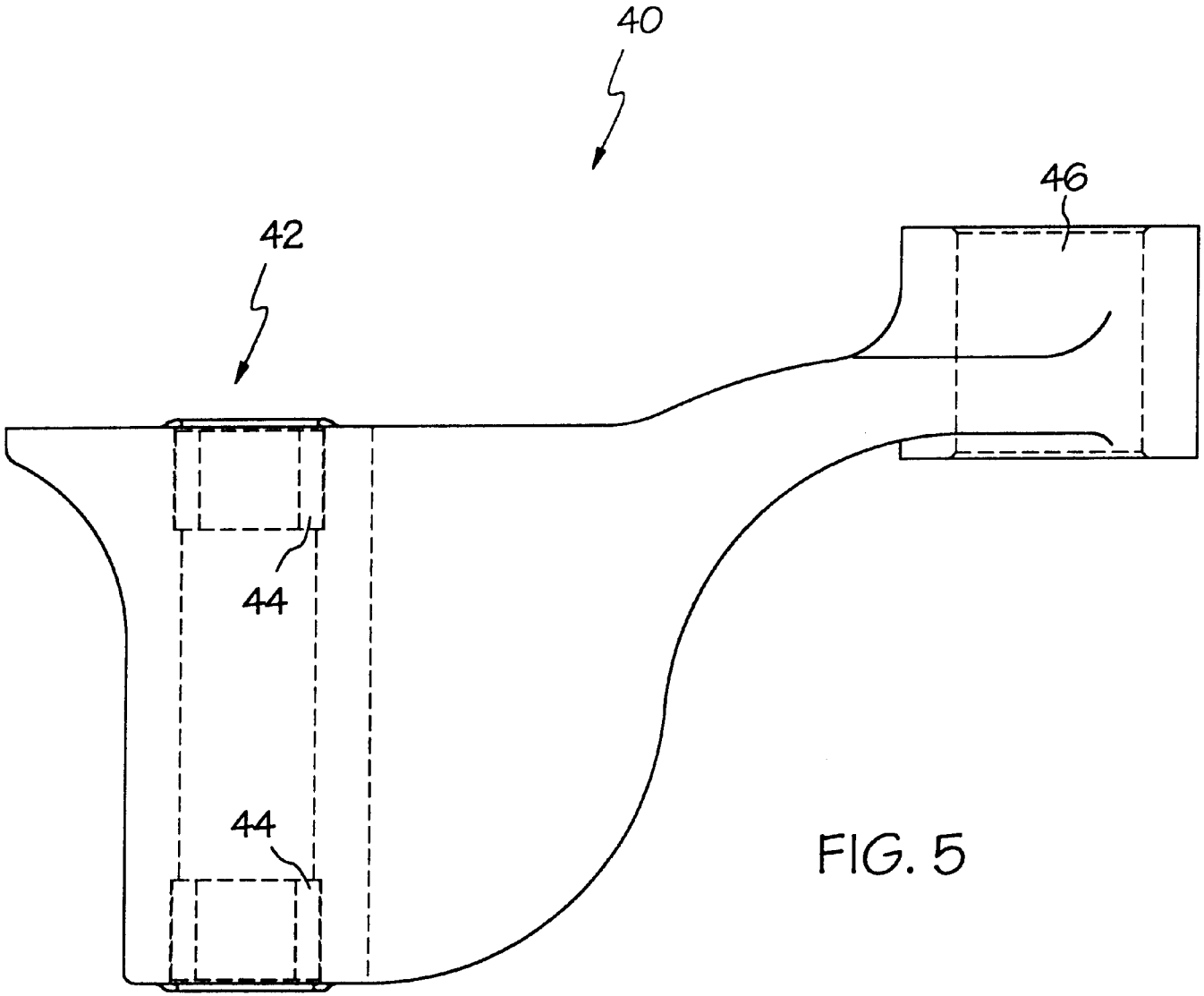
FIG. 5 is a front elevational view of the food grip support which is shown as part of the carriage of FIGS. 1 and 4.

As shown in FIG. 5, the food grip support 40 has a through hole 42 so that it is capable of being slidably mounted on the slide rod 26. For enhanced movement, bushings 44 may be utilized within the bore in order to allow the food grip to rotate freely and "float" on the slide rod. FIG. 5 shows the bushings 44 in the through hole 42, such that the bushings are allowed to rotate freely in the through hole. The food grip support 40 further includes a second through hole 46 to receive the food grip 24 itself. The food grip comprises a shaft which fits through hole 46. The shaft has a grip portion on one end thereof and a handle at the opposite end. The food grip 24 may rotate within the support 40, which is itself rotatable about the slide rod 26. Additionally, as shown in FIG. 1, the food grip preferably includes a plurality of teeth 48 that point toward the gauge plate to grip the food product as it is pushed toward the slicing knife and teeth 49 which point toward the tray shown in FIG. 2 to hold the food product against the tray 12. Food grip 24 also has a handle 50 for use in placing or lifting the food grip.

Figure 6:
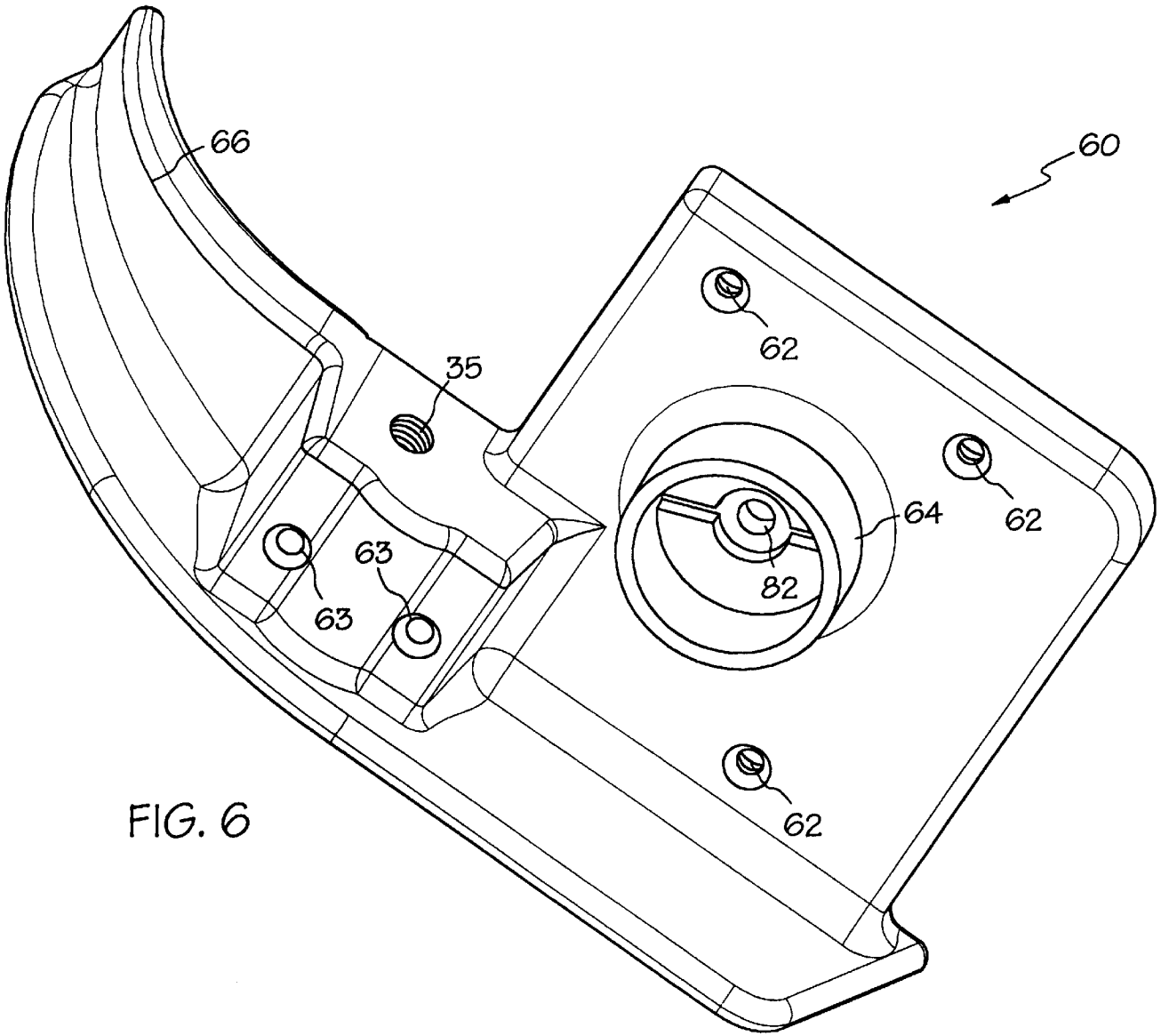
FIG. 6 is a perspective view of the handle support portion of the carriage shown in FIG. 1.

The carriage 10 of the present invention further comprises a handle support 60 located on the tray portion of the carriage closest to the knife blade. The handle support 60, which is detailed in FIG. 6, may be mounted onto the carriage tray by weld nuts or other means. It is preferably mounted on the outside of the carriage so as to not interfere with the food product on the carriage. The support may alternately be attached by means of five screws 61 as shown in FIG. 3 which go through holes 62 and 63 shown in FIG. 6, or any other suitable means as will be apparent to those of skill in the art. The support 60 includes a slicer handle attachment boss 64, a threaded bore attachment 35 for receiving the threaded boss on the slide rod, and an extension 66.

The carriage 10 includes at least one and preferably two handles so that the carriage can be reciprocated or moved into position for automatic slicing. Primary handle 80 is attached to the handle support 60 by a screw or other attaching means through a hole 82 in the center of the handle attachment boss 64.

The primary handle 80 extends downwardly from the upstanding retaining wall 20 of the tray 12. Handle 80 is preferably long enough that it can be gripped several places along its length. The handle 80 is further preferably located at a position which is comfortable to a majority of users without requiring a high degree of force to move the carriage. In addition, the handle 80 may have a textured outer surface to improve the friction with the user's hand.

As shown in FIGS. 1 and 2, the carriage 10 optionally includes a separate secondary handle 90 in addition to the primary handle 80. The secondary handle 90 may be mounted on a secondary handle support 92 which is shown in FIG. 3. The secondary handle support 92 is mounted at a distance from the first handle 80 further upwards on the upstanding retaining wall 20 of the tray 12. The secondary handle is also preferably long enough to be grasped at a plurality of places, and may include a textured outer surface. When both the primary and secondary handles are mounted, the user may grasp either or both handles to move the carriage.

Figure 4:
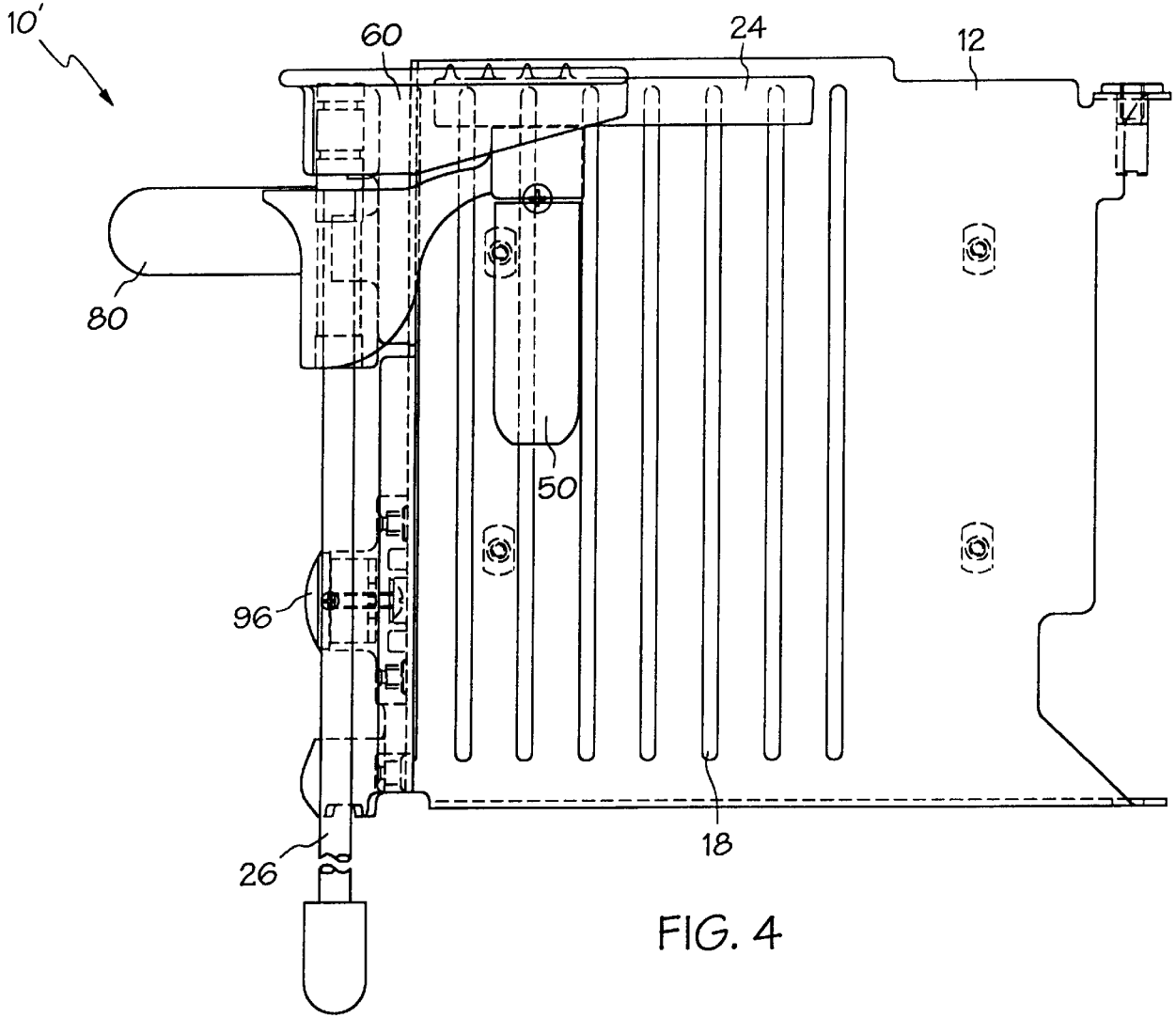
FIG. 4 is an alternative embodiment of the carriage of the present invention having only one handle.

Preferably, the angle at which this second handle 90 extends is adjustable. The handle has a rib on its end facing support 92 which fits into one of three grooves 94 in the support 92. However, in place of three adjustments, any number of adjustment positions, or adjusting means, may be utilized. The grooves 94 extend radially from a common axis. When its angle is shifted, the end of the handle remains in the same place, but the angle at which the grip extends may be altered. Therefore, the angular position at which the handle extends can be adjusted according to the preferences of a given user. When the angular position is selected, the handle is attached to the support 92 by a screw 95 or similar attachment. In addition, the first handle 80 may also be made angularly adjustable in a similar manner. When the second handle is not being used on the carriage, the hole on the support 92 can be capped 96 as shown in alternative carriage 10' of FIG. 4.

Depending on the stature of the user, one of the handles may be more convenient than the other. In addition, each user will tend to take different positions during the slicing process. For example, when a user is changing the thickness of the slice, they will tend to bend over the slicing apparatus, looking over the top of the slicer to the platform where the food is collected to examine the amount of food sliced or its thickness. In this situation the user is enabled to grasp a different handle then when they are in a normal standing position.

The food grip 24 can be lifted away from the base of the carriage during the insertion of a new food product or cleaning of the slicer. In order to do this, the user grasps the handle 50 and rotates the grip support 40 along the slide rod axis 26. As shown in FIG. 3 the second handle support 92 also preferably includes a hanger 98 for the food grip 24 to rest when not in use. The food grip can rest on the hanger so that it is out of the way during the loading of the carriage or cleaning of the slicer.

The method of manually operating a slicer 100 including the carriage 10 of the present invention will now be disclosed. The user places a food product to be sliced on the carriage with the side to be sliced facing downward toward the slicing blade. The food grip 24 is grasped by the handle 50 and lifted from the hanger 98. Then the grip support 40 is rotated around the slide rod 26 such that the teeth 48 of the grip 24 are placed against the food product. The user then starts the motor which activates the slicing blade 104. The user grasps one of the handles 80 or 90 and reciprocates the carriage 10 back and forth across the slicer blade until the desired amount of food product has been cut. Then the motor is turned off, the food grip 24 is rotated out of the way, and the product is removed. If necessary, the carriage can then be removed or pivoted away from the slicing blade for cleaning or servicing.

In an automatic slicer, the method of use is similar to that described above for a manual slicer. However, in place of user-driven reciprocation, a motor drives the carriage. The automatic slicer may also control the system such that the carriage automatically terminates the slicing process after a preset number of slices have been cut or the preset total weight of the cut slices has been reached. The automatic control may also control the length of travel and/or speed of the carriage.

In view of the foregoing disclosure it will be apparent that the invention includes a carriage in which a slide rod can be alternatively positioned with respect to the food product; a handle support on which a secondary handle can be mounted and pivotably adjusted and a food grip which is freely pivotable about the slide rod by means of a linkage.

Having described the invention in detail and by reference to preferred embodiments thereof, it will be apparent that modifications and variations are possible without departing from the scope of the invention as defined in the appended claims.

What is claimed is:

1. A carriage for a food slicer comprising:

a tray for supporting a food product, said tray including first and second sides defining a length of said tray, each of said first and second sides having a threaded aperture positioned proximate thereto, and third and fourth sides defining a width of said tray, wherein each threaded aperture faces toward said fourth side of said tray;

a slide rod having a threaded end removably attached to one of said threaded apertures and extending along the width of said tray from said third side of said tray toward said fourth side of said tray;

a food gripping portion including a food grip and a support, the support slidably attached to said slide rod for sliding along a length thereof to adjust a position of the food grip relative to said third side of said tray, the support rotatably attached to said slide rod for rotating the food grip relative to said tray;

a first handle extending from said tray; and a seconded handle attached to and extending from said tray at a distance from said first handle, wherein at least one of said handles is adjustable so that an angle of one of said handles relative to the other of said handles is adjustable.

2. The carriage of claim 1 wherein each threaded aperture is located proximate to said third side of said tray.

3. The carriage of claim 1 wherein said first and second handles each extend from the same one of said sides.

4. The carriage of claim 1 wherein the tray further comprises a handle support positioned at said first side of said tray proximate to said third side thereof, one of said threaded apertures being located on said handle support.

5. The carriage of claim 4 wherein said first handle is attached to said handle support.

6. A multi-configuration carriage for a food slicer comprising:

a tray for supporting a food product, said tray having a first threaded rod attachment at a first side thereof, the threaded rod attachment facing toward an opposing second side of said tray;

a handle support attached to said tray proximate to said first side thereof, the handle support having a second threaded rod attachment facing toward the opposing second side of said tray;

a slide rod having a threaded end and being removably attached to one of said first and second threaded rod attachments;

an intermediate food grip support slidably received on said slide rod, said food grip support rotatable about said slide rod;

a food grip attached to said intermediate food grip support;

a first handle attached to said handle support; and a second handle attached to and extending from said tray at a distance from said first handle, wherein at least one of said handles is adjustable so that an angle of one of said handles relative to the other of said handles is adjustable.

* * * * *

UNITED STATES PATENT AND TRADEMARK OFFICE

CERTIFICATE OF CORRECTION

PATENT NO. : 6,167,791 B1
DATED : January 2, 2001
INVENTOR(S) : Thomas B. Heckman et al.

It is certified that error appears in the above-identified patent and that said Letters Patent is hereby corrected as shown below:

Title page,
Item [75], Inventors, after inventor "Robert Gerry Radwin" the city "Waunakee" should be -- Madison --.
Item [57], ABSTRACT,
Line 1, the ";" after the word slicer should be -- , --.

Column 6,
Line 36, the word "seconded" should be -- second --.

Signed and Sealed this

Tenth Day of August, 2004

JON W. DUDAS
*Acting Director of the United States Patent and Trademark Office*